US006048478A

United States Patent [19]

Weihrauch

[11] Patent Number: 6,048,478

[45] Date of Patent: Apr. 11, 2000

[54] PROCESS FOR PRODUCING BRISTLE MATERIAL FOR BRISTLE GOODS

[75] Inventor: Georg Weihrauch, Wald-Michelbach, Germany

[73] Assignee: Pedex & Co GmbH, Wald-Michelbach, Germany

[21] Appl. No.: 09/171,001

[22] PCT Filed: Apr. 17, 1997

[86] PCT No.: PCT/EP97/01916

§ 371 Date: Oct. 9, 1998

§ 102(e) Date: Oct. 9, 1998

[87] PCT Pub. No.: WO97/39651

PCT Pub. Date: Oct. 30, 1997

[30] Foreign Application Priority Data

Apr. 24, 1996 [DE] Germany ..... 196 16 309

[51] Int. Cl.[7] ..... B29C 47/00; B29D 31/00; D02G 3/04

[52] U.S. Cl. ..... 264/103; 264/148; 264/151; 264/171.1; 264/177.13

[58] Field of Search ..... 264/103, 148, 264/151, 171.1, 177.13

[56] References Cited

U.S. PATENT DOCUMENTS

| | | | |
|---|---|---|---|
| 2,710,774 | 6/1955 | Baumgartner . | |
| 4,325,900 | 4/1982 | Holding et al. | 264/103 |
| 4,804,232 | 2/1989 | Weihrauch | 300/21 |
| 5,151,229 | 9/1992 | Burns | 264/148 X |

FOREIGN PATENT DOCUMENTS

| | | | |
|---|---|---|---|
| 086 412 | 8/1983 | European Pat. Off. . | |
| 3 50 450 | 1/1990 | European Pat. Off. . | |
| 680 707 | 11/1995 | European Pat. Off. . | |
| 1 134 245 | 11/1995 | France . | |
| 32 05 641 | 9/1983 | Germany . | |
| 36 43 202 | 3/1988 | Germany . | |
| 37 18 811 | 3/1988 | Germany . | |
| 43 14 692 | 11/1994 | Germany . | |
| 223251 | 11/1968 | United Kingdom | 264/148 |
| 2 022 197 | 12/1979 | United Kingdom . | |

*Primary Examiner*—Leo B. Tentoni
*Attorney, Agent, or Firm*—Paul Vincent

[57] ABSTRACT

For the manufacture of bristle material for brushes with different types of plastic bristles, which are produced as continuous monofilaments by extrusion, different types of continuous monofilaments are combined in the composition desired for the finished brushes into a mixed strand and wound up and subsequently from the mixed strand is cut the bristle material required for the brushes.

10 Claims, 4 Drawing Sheets

PROCESS FOR PRODUCING BRISTLE MATERIAL FOR BRISTLE GOODS

BACKGROUND OF THE INVENTION

The invention relates to a method for the manufacture of bristle material for brushes with different types of plastic bristles produced as continuous monofilaments by extrusion.

In the present context the term brushes applies to all products in which more than one type of bristle undergoes processing to brushes, brooms, scrubbing brushes, paint brushes, brushing belts, mats with a bristle facing, etc. Bristle material is understood to mean any composition of bristles having a finite length, which is processed either directly or after further cutting to size to form the brush.

The bristles forming the bristle facing are usually identical in brushes, i.e. are made from the same material and have the same geometrical dimensions. The only differences which exist relate to the length. However, brushes are also known, in which the bristle facing comprises individual bristle bundles or packets with different types of bristles in the bundle or packet. The different nature more particularly applies to the bristle diameter or material. This is firstly intended to give optical effects, but also the different characteristics of the bristles can be utilized, so that different types of actions are produced when using the brush. The best known differences are provided by mixtures of natural and plastic bristles, the mixture mainly serving to partly replace the more expensive natural fibres, without having to completely lose the advantageous characteristics of the natural bristles. Such mixtures are more particularly known in connection with paint brushes and brooms.

Plastic bristles are produced from continuously extruded monofilaments, which are wound up after extrusion. Prior to winding or during a further rewinding, said monofilaments are generally stretched to give them the desired bending behaviour. The molecular longitudinal orientation attained on stretching is optionally fixed by thermal stabilization. The monofilaments are then combined into strands and from the latter are cut tufts or knots, whose length is a multiple of the length of the subsequent bristles. These tufts surrounded with an envelope are subsequently cut into short-cuts, whose length roughly corresponds to that of the bristles. The short-cuts enclosed by the envelope are then used in brush manufacture, where the envelope is separated and the bristles are generally transferred to a magazine. From said magazine by splitting off individual bundles are removed and are then fixed to the carrier or support by a mechanical or thermal process.

In order to obtain with this procedure a bristle facing of bundles or packets with different types of bristles, the tufts or short-cuts with different types of bristles are horizontally positioned in juxtaposed manner after removing the envelope and are transversely mixed by coating over several times, after which they are again brought together and bundled. The composition and/or homogeneity of the mixture is largely left to chance and is generally completely inadequate. In addition, on mixing there is an undesirably high bristle material wastage. However, this mixing procedure is also very expensive due to the high machine and time costs. The mixing of rough and uneven plastic bristles is only possible, if at all, with unacceptable waste levels due to the combing necessary for orienting the bristles in the transverse position. The mixing of smooth plastic bristles is problematical due to their good sliding characteristics. The brushes manufactured in this way are not of good quality, i.e. particularly with respect to the orientation of the different types of bristles in the bundle or in the entire bristle facing.

In another procedure the continuous monofilaments are processed directly from the reel, in that the monofilament strand, in which the monofilaments are present in a number corresponding to the subsequent bundles or facing, are directly removed at the place of manufacture. There the leading end of the strand is positioned, optionally simultaneously thermally fixed to the bristle carrier and then cut to a length corresponding to the desired bristle length from the continuous strand. This procedure does not allow the aforementioned mixing to be carried out.

The problem of the invention is to provide a method permitting the manufacture of brushes with different types of plastic bristles, independently of which of the two aforementioned procedures is used during the manufacture of the brush and at the same time leads to a reduction in the cost of the plastic bristle mixture and ensures a mixture with a clearly defined composition.

This purpose is achieved in accordance with the invention in that differing types of endless monofilaments are brought together in the direction of their longitudinal extension to form a mixed strand having a composition desired for the completed brushes, the mixed strand is wound up, and the bristle material needed for the production of the brushes is cut to length from the mixed strand.

SUMMARY OF THE INVENTION

Therefore the desired bristle mixture is produced by bringing together or combining continuous monofilaments. This can take place in connection with the manufacture of the continuous monofilaments during winding after extrusion, but can also take place subsequently from the production reels. This in particular makes it possible to obtain a clearly defined composition within the mixed strand of different types of continuous monofilaments produced and this is retained until the bristles are cut from the strand to the final size or any random intermediate size. Due to the omission of a manual or mechanical mixing process, there is also a saving of equipment and space. In addition, there is also no undesired bristle material wastage. Therefore, whilst simultaneously reducing costs, the finished brushes can fulfil maximum quality requirements. The invention also offers a hitherto unavailable possibility of producing differently structured and/or profiled bristles in a mixture, in that correspondingly structured or profiled continous monofilaments, optionally with smooth monofilaments, are brought together to form the mixed strand. In the hitherto conventional mechanical or manual mixing no clearly defined mixtures can be produced from such structured or profiled bristles, because the latter have a separation tendency or do not even allow mixing to take place.

An advantageous variant of the method is characterized in that the mixed strand is rewound one or more times, so that homogeneous fine mixtures can be produced.

The principle according to the invention can be implemented in numerous variants. Thus, the different types of continuous filaments can be combined in a composition corresponding to individual bristle bundles or a bristle packet of the brush to give a mixed strand, which is wound up and subsequently from the latter the bundles or packets are cut in the desired bristle length or a multiple thereof.

This variant leads to the production of mixed strands, in which the number and characteristics of the monofilaments are already present in the form desired subsequently in the bristle bundles or packet to be fixed to the bristle carrier.

This variant will in particular be chosen in the case of larger diameter bundles, either in that the bundle has a correspondingly large number of bristles or bristles with a larger diameter. This method is also suitable for producing bristle packets with a larger cross-section.

This procedure is also suitable for so-called continuous processing, in which the unwound strand is connected by its leading end to a support and during or after fixing the bristles are cut from the strand. Fixing generally takes place by a thermal process, namely welding, injection, punching in, etc.

Instead, the method can also be performed in such a way that the different types of monofilaments are combined into a mixed strand, in which the monofilaments are present in a uniformly mixed number representing a multiple of the number of bristles in an individual bristle bundle and from the mixed strand, following unwinding, are cut tufts having a multiple of the bristle length, the tuft is enclosed within an envelope and subsequently the enveloped tuft is cut into short-cuts in a length corresponding to that of the bristles from which individual bundles of different types of bristles are obtained by dividing up.

Here again, via the intermediate stage of short-cutting, all the disadvantages of the known mixing procedure are avoided. The bundles can be fixed mechanically, e.g. by punching or adhesion, or by any thermal process.

With the method according to the invention it is possible to combine continuous monofilaments with a different diameter and/or material and/or profile and/or different surface structure and/or colour to give a mixed strand, optionally accompanied by the intermediate winding of thinner strands.

The invention is described in greater detail hereinafter relative to various variants and with reference to the attached drawings, wherein show:

BRIEF DESCRIPTION OF THE DRAWINGS

FIG. 4*b* A second variant for the production of a mixed strand.

Figure 1:
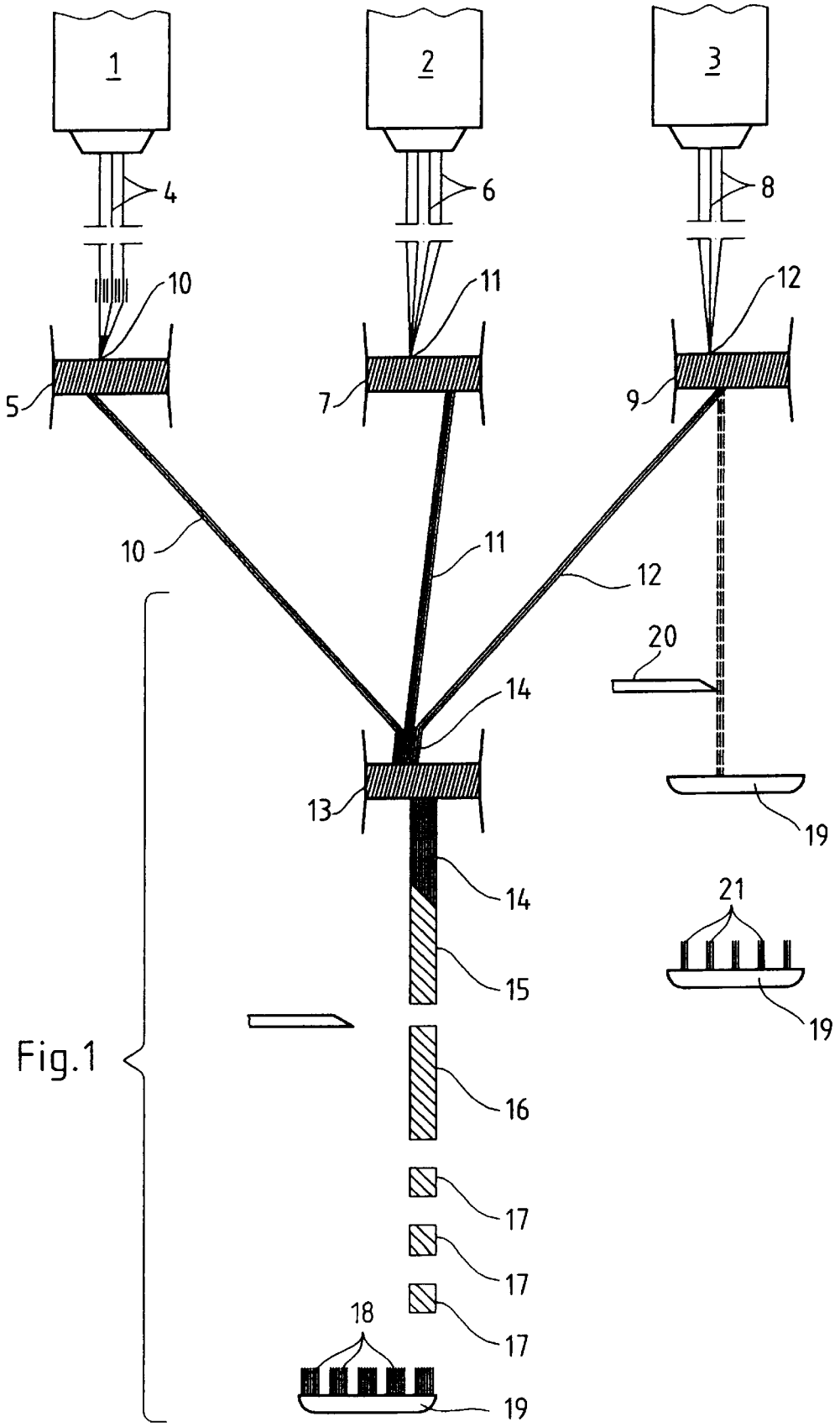
FIG. 1 A view of a plant for producing the bristle material and the finished brushes in an in-line method.
Figure 2:
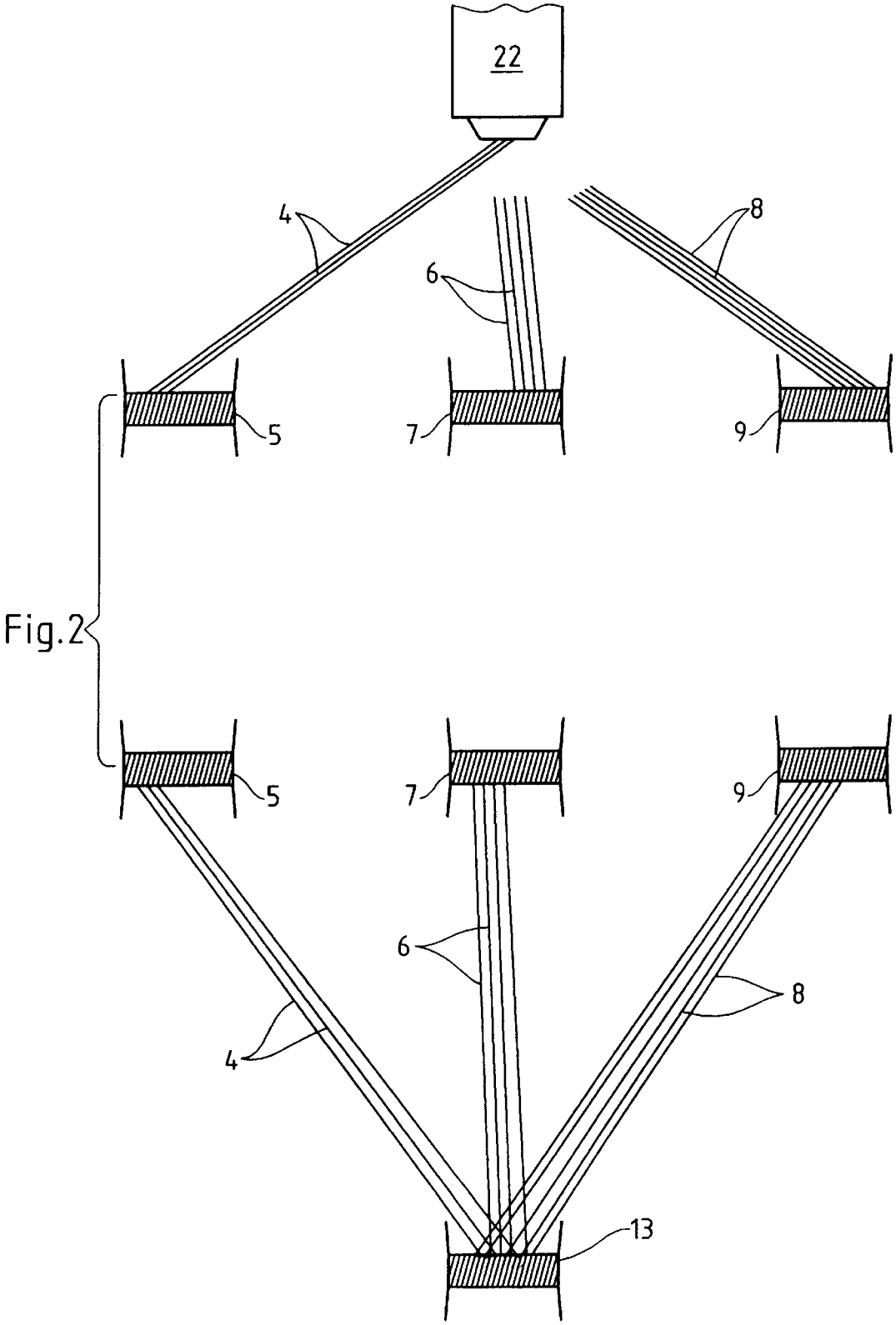
FIG. 2 A variant of the method according to FIG. I with discontinuous operation.

1, 2 and 3 are extruders, in each case equipped with multiple dies. For example, the extruders 1 and 3 operate with triple dies and the extruder 2 with quadruple dies, but random other numbers of dies and particular larger numbers can be used. The continuous monofilaments 4 produced by the extruder 1 are, optionally following a drawing zone and a thermal stabilization, wound onto a reel 5. In the same way the extruder 2 is followed by a reel 7 and the extruder 3 by a reel 9, which receive the monofilaments 6 leaving the extruder 2 and the monofilaments 8 leaving the extruder 3 respectively.

The monofilaments 4, 6 and 8 can e.g. differ as regards diameter or material, colour or surface structure, or transverse or longitudinal profile. From the reels the monofilaments are combined into a strand 10, 11 or 12 and said strands are then wound up. From the strands 10, 11 and 12 with the different types of monofilaments, as a result of the combination of the strands and rewinding on a reel 13, a single mixed strand 14 is produced, in which the different types of monofilaments are mixed in a clearly defined form.

The mixed strand 14 with different types of monofilaments is drawn from the reel 13 and, starting from its leading end is enveloped with a sleeve or envelope 15. From the enveloped mixed strand 14 are cut tufts 16 in clearly defined lengths and from same by further cutting are obtained several short-cuts 17, which are either directly processed to brushes or are supplied to the brush manufacturer. The short-cuts 17 are freed from the envelope at the brush manufacturing point and optionally magazined. From the magazined short-cuts are divided off individual bundles 18 and fixed to the bristle carrier 19.

In place of the aforementioned procedure the strand 14 can be cut to a tuft length prior to the winding of the sleeve 15. This strand portion can optionally be combed out and subsequently the monofilaments are again combined into a tuft 16 and are enveloped. This is followed by the manufacture of the short-cuts in the aforementioned manner.

Another variant of the method is shown in the right-hand part of the drawing. In this variant, e.g. by the extruder 3 are produced monofilaments 8 having a different cross-section and/or cross-sectional shape and/or different colour and are brought together on the reel 9 directly to form a mixed strand. This mixed strand with different types of monofilaments in a clearly defined mixture is then either drawn directly from the reel 9 or following a rewinding process and is directly transferred to brush manufacture. The strand is then fixed by its leading end to the bristle carrier, e.g. using a thermal process. In conjunction with or after fixing the strand is cut to the desired length, as indicated at 20. In this method preferably several reels with identical strands are combined into a reel set and by drawing off the strands all the bundles 21 are simultaneously fixed to the bristle carrier 19. In this case the reels can also contain mixed strands with monofilaments with a different composition, so that to the bristle carrier 19 can be fixed bundles with bristles having different compositions in an optionally predetermined geometrical distribution.

In place of the in-line method shown in FIG. 1, it is also possible to operate in the hitherto conventional manner, i.e. the continuous monofilaments 4, 6 and 8 following winding onto the reels 5, 7 and 9 are wound together onto a reel 13 at another location, e.g. at the premises of the brush manufacturer, in order to produce the mixed strand. Instead of extruding the different types of continuous monofilaments 4, 6 and 8 from three different extruders, a single extruder 22 can be provided, which successively produces the different types of continuous monofilaments.

Figure 3:
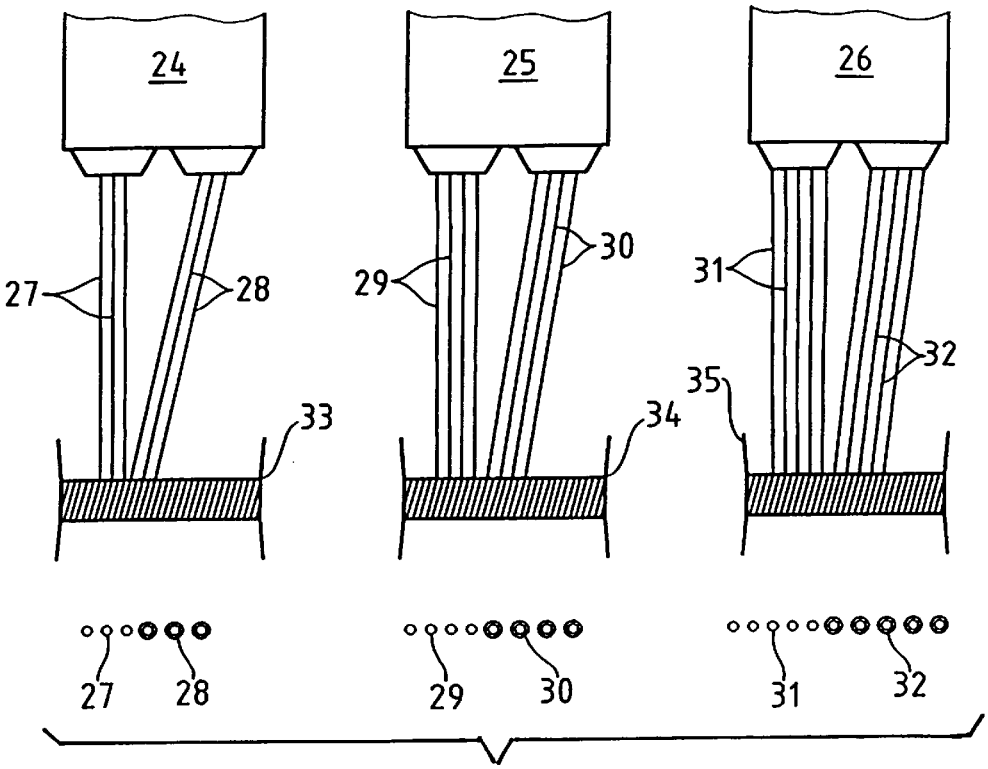
FIG. 3 Variants of a plant for producing a mixed strand.
Figure 5:
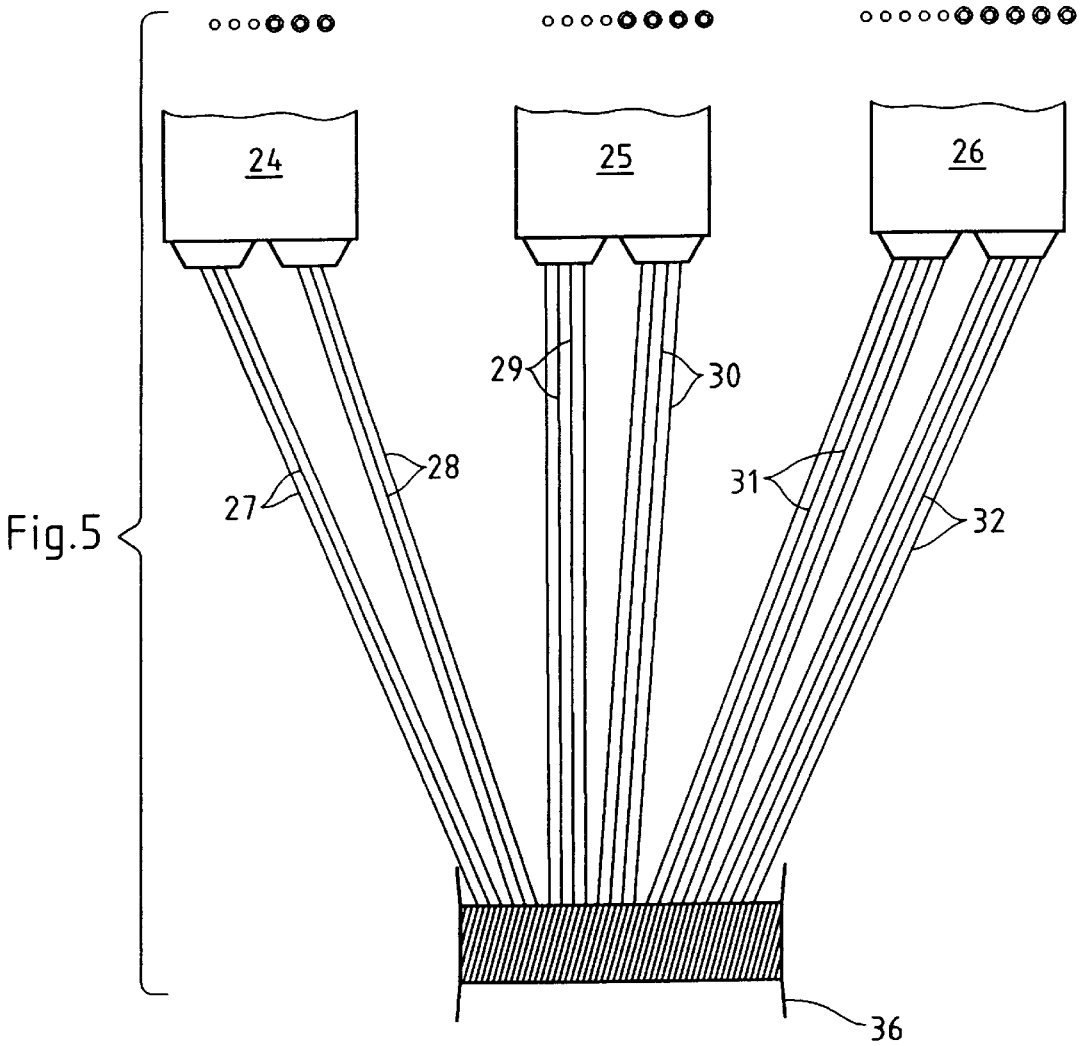
FIG. 5 A final variant with coextrusion of different types of monofilaments.

FIG. 3 shows three extruders 24, 25 and 26, which are used for the coextrusion of different types of continuous monofilaments 27 to 32, which e.g. differ as regards diameter, colour, etc. and after winding onto reels 33, 34 and 35, on which there is already a premixture, are combined to form a mixed strand. This is illustrated in another variant in FIG. 5, where the different types of monofilaments are wound together on a reel 36 to form a mixed strand.

Figure 4A:
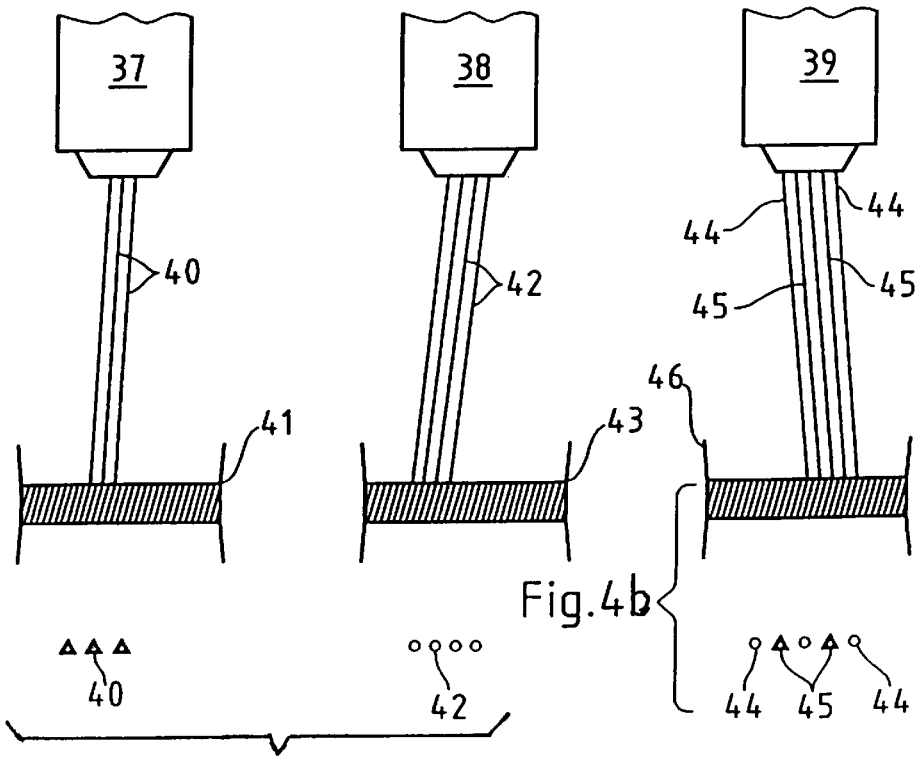
FIG.4*a* A first variant for the production of a mixed strand.

Finally, FIG. 4*a* shows a variant in which continuous monofilaments with different cross-sections are produced. Thus, extruder 37 produces monofilaments with a triangular cross-section, which are wound onto a reel 41, whilst extruder 38 produces monofilaments 42 with a circular cross-section, which are wound onto a reel 43. From the reels 41, 43 the mixed strand can be produced by rewinding. FIG. 4*b* shows a variant, in which the extruder 39 produces continuous monofilaments with different cross-sectional shapes with a corresponding die configuration. These different types of continuous monofilaments 44, 45 are directly combined on a reel 46, on which the mixed strand is formed. The mixed strand can also be obtained by rewinding onto another reel.

I claim:

1. A method for the manufacture of bristle material for brushes with different types of plastic bristle using different types of extruded plastic continuous monofilaments, the method comprising the steps of:

a) combining said different continuous monofilaments in a longitudinal direction thereof into a composition desired for finished brushes to form a mixed strand comprising a defined mixture of spatially distributed, substantially mutually parallel different continuous monofilaments;

b) winding said mixed strand; and c) cutting said mixed strand into bristle lengths for manufacture of brushes.

2. The method of claim 1, further comprising the steps of combining at least two monofilaments of a first type into a first bristle strand and combining at least two monofilaments of a second type into a second bristle strand, wherein said first and said second strands are combined in step a) to form said mixed strand.

3. The method of claim 1, further comprising the step of rewinding said mixed strand at least one time.

4. The method of claim 1, wherein said different types of continuous monofilaments are combined into said mixed strand in a composition corresponding to an individual bristle bundle or a bristle packet for the brushes and wherein step c) comprises the step of cutting said bundle or packet to one of a desired bristle length and a multiple of said desired bristle length.

5. The method of claim 1, wherein said different types of continuous monofilaments are combined into said mixed strand in which said monofilaments are uniformly mixed in a number which is a multiple of a number of bristles in a single bristle bundle, and further comprising the steps of cutting a bunch having a length which is a multiple of a bristle length and capturing said bunch in a jacket, wherein step c) comprises the step of cutting said bunch to said bristle length, and further comprising the step of separating out individual bundles from a cut bunch.

6. The method of claim 1, wherein said mixed strand comprises different monofilament types having at least one of a different diameter, a different material, a different profile, a different surface structure, and a different color.

7. The method of claim 5, wherein said mixed strand is combined directly in step a).

8. A method for the manufacture of bristle material for brushes using a plurality of different types of extruded plastic continuous monofilaments produced by at least one of differing extrusion processes and differing plastics, each of said different types of continuous monofilament being wound onto a separate reel to produce a plurality of reels, the method comprising the steps of:

a) selecting a number of reels from the plurality of reels, and b) winding monofilaments from said selected number of wound reeds onto a further reel to produce a defined mixture of different continuous monofilaments on said further reel.

9. A method for the manufacture of bristle material for brushes using a different groups of extruded plastic monofilaments produced by at least one of differing extrusion processes and differing plastics, each of the different monofilament groups being wound onto a separate reel to produce a plurality of reels, the methodcomprising the steps of:

a) selecting a first group of continuous monofilaments on a first reel and a second group of continuous monofilaments on a second reel from the plurality of reels, said first group differing from said second group;

b) winding said first and said second groups of continuous monofilaments together onto a third reel to produce a defined mixture of different continuous monofilaments, said defined mixture having a homogeneity; and c) rewinding said defined mixture of monofilaments onto a fourth reel to increase said homogeneity.

10. A method for the manufacture of bristle material for brushes using different groups of extruded plastic monofilaments produced by at least one of differing extrusion processes and differing plastics, each of the different monofilament groups being wound onto a separate reel to produce a plurality of reels, the method comprising the steps of:

a) selecting a first group of continuous monofilaments on a first reel and a second group of continuous monofilaments on a second reel from the plurality of reels, said first group differing from said second group; and b) feeding and winding said first and said second group of continuous monofilaments onto a third reel to spatially distribute and intermingle said first and said second group of continuous monofilaments into a substantially homogenous mixture of continuous monofilaments.

* * * * *

UNITED STATES PATENT AND TRADEMARK OFFICE

CERTIFICATE OF CORRECTION

PATENT NO. : 6,048,478

DATED : April 11, 2000

INVENTOR(S) : WEIHRAUCH, Georg

It is certified that error appears in the above-indentified patent and that said Letters Patent is hereby corrected as shown below:

Please insert as a paragraph in column 2, between lines 50 and 51 thereof --..

The continuous monofilaments can either be combined individually or directly to form the mixed strand. Instead of this it is also possible for two or more strands with in each case different continuous monofilaments, but which are the same within the strand, to be wound together to form a single mixed strand. This enables the brush manufacturer to keep in stock the wound bristle material and when required produce the desired mixture --.

Signed and Sealed this

Twenty-seventh Day of March, 2001

Nicholas P. Godici

*Attest:*

NICHOLAS P. GODICI

*Attesting Officer*

*Acting Director of the United States Patent and Trademark Office*